United States Patent [19]

Rinkewich

[11] Patent Number: 4,534,510

[45] Date of Patent: Aug. 13, 1985

[54] AREA PATTERN CONTROLLED SPRINKLER

[76] Inventor: Isaac Rinkewich, 12 Fishman Maimon St., Tel-Aviv, Israel

[21] Appl. No.: 594,726

[22] Filed: Mar. 29, 1984

[30] Foreign Application Priority Data

Oct. 21, 1983 [IL] Israel ..... 70024

[51] Int. Cl.[3] ..... B05B 3/04

[52] U.S. Cl. ..... 239/97; 239/239; 239/240

[58] Field of Search ..... 239/DIG. 1, 236, 237, 239/240, 263, 239, 242, 97, 99, 101

[56] References Cited

U.S. PATENT DOCUMENTS

| | | | |
|---|---|---|---|
| 3,091,399 | 1/1963 | Kennedy | 239/DIG. 1 |
| 3,362,641 | 1/1968 | Barnes | 239/237 |
| 4,277,029 | 7/1981 | Rabitsch | 239/236 |

*Primary Examiner*—Jeffrey V. Nase
*Assistant Examiner*—Scott D. Malpede
*Attorney, Agent, or Firm*—Banjamin J. Barish

[57] ABSTRACT

An area pattern controlled sprinkler comprises a nozzle rotatably mounted about a vertical axis through the sprinkler and driven by the energy of the water in the pressurized water supply line, a plunger also driven by the pressurized water to restrict and enlarge the nozzle, and a cam member controlling the displacement of the plunger so as to produce a water distribution pattern of predetermined configuration around the sprinkler.

18 Claims, 12 Drawing Figures

428
432
422
426
424
434
430
414
420
473
472
456
456'
420a
420b
416
418
420c
438
440
442
412
470
471
a
b
413
402
408
406
404
410

470
471
420

414
456a
456b
456c

AREA PATTERN CONTROLLED SPRINKLER

RELATED APPLICATIONS

The present application relates to water sprinklers as described in my patent application Ser. No. 594,727 filed concurrently herewith.

The above-cited patent specification discloses a water sprinkler comprising a housing having an inlet connectable to a pressurized water supply line, and a nozzle through which the water issues in the form of a jet; a control member cyclically movable to restrict and enlarge the nozzle; and a drive driven by the energy of the water in the pressurized water supply line for cyclically driving the control member to restrict and enlarge the nozzle. In the preferred embodiments of the invention therein described, the nozzle includes a throat, and the control member is in the form of a plunger cyclically reciprocated by the drive to restrict and enlarge the nozzle throat. In addition, the nozzle is carried by a sprinkler head rotatably mounted to the housing, the drive also cyclically displacing the sprinkler head about the vertical axis of the sprinkler.

As further described in that patent specification, a sprinkler constructed in accordance with the foregoing features is based on the known principle that sprinkler range is directly proportional to nozzle size; the larger the nozzle size, the longer the range for the same water pressure. Thus, the novel sprinklers therein described enable larger sized nozzles to be used for increasing the range without increasing the discharge rate, by driving the control member (i.e., the reciprocatory plunger) to cyclically restrict and enlarge the nozzle discharge area.

BRIEF SUMMARY OF THE PRESENT INVENTION

According to the invention of the present application, the foregoing sprinkler construction is used for producing water distribution patterns of predetermined configurations around the sprinkler. For example, in many cases, it is desirable to produce a substantially square water distribution pattern, rather than the conventional circular one, in order to provide a more uniform coverage of an area to be irrigated by a plurality of sprinklers.

According to a broad aspect of the present application, therefore, there is provided a water sprinkler according to the foregoing features, wherein the nozzle is displaceably mounted to the housing about a vertical axis thereof, the sprinkler further including a cam member effective, during the cyclical displacement of the nozzle about the vertical axis, to control the displacement of the plunger so as to produce a water distribution pattern of predetermined configuration around the sprinkler. For example, in producing a square pattern, the range and rate are both increased by 40% to obtain uniform distribution.

BRIEF DESCRIPTION OF THE DRAWINGS

The invention of the present application is herein described, by way of example only, with reference to the accompanying drawings, wherein.

DESCRIPTION OF PREFERRED EMBODIMENTS

Figures 1, 1A, 1B:
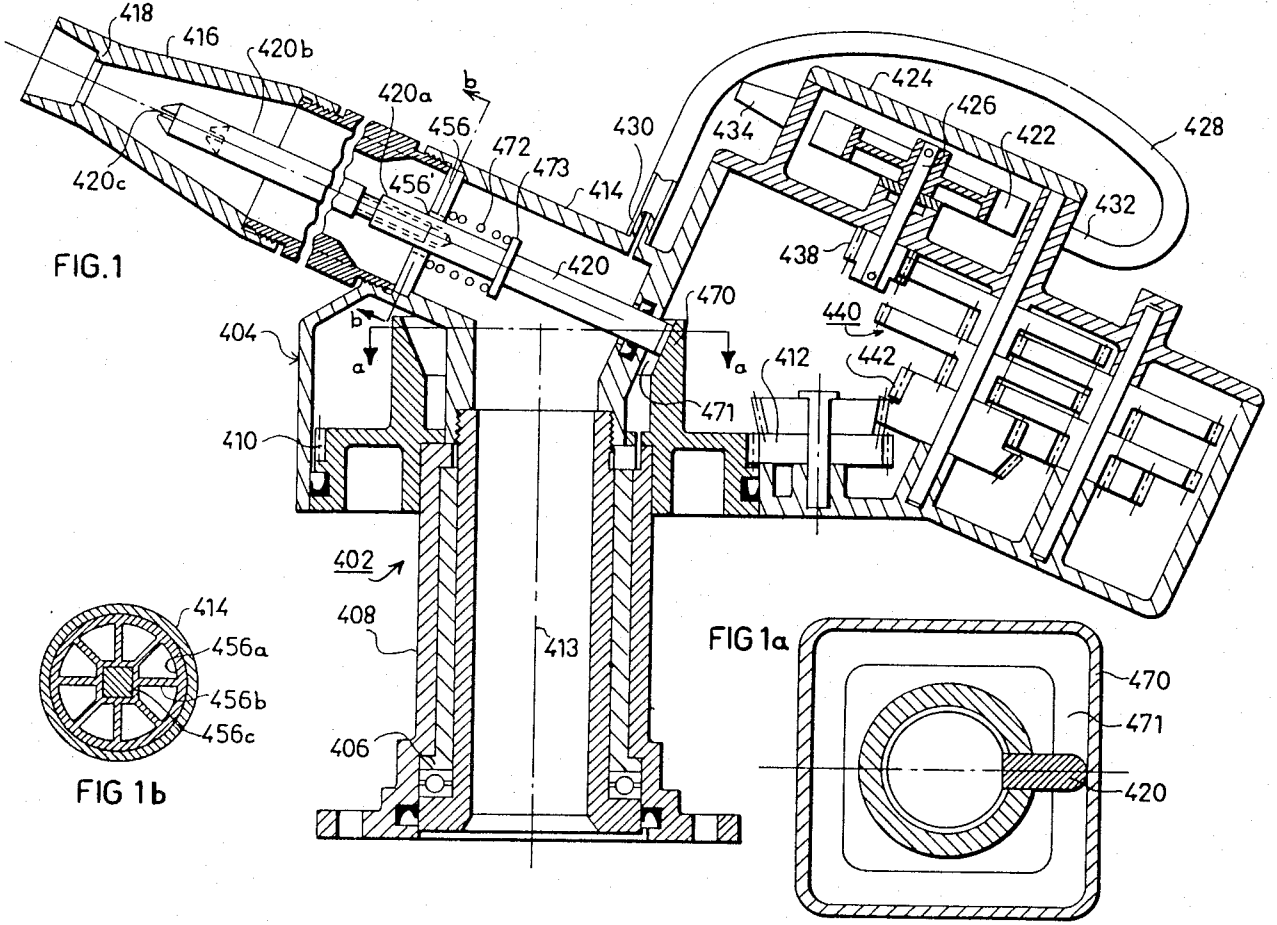
FIG. 1 is a longitudinal sectional view illustrating one water sprinkler constructed in accordance with the present invention, FIGS. 1*a* and 1*b* being sectional views along lines a—b and b—b of FIG. 1.

The sprinkler illustrated in FIG. 1 is generally similar to that illustrated in FIG. 1 of the above-cited patent application. It comprises a housing 402 including a sprinkler head 404 rotatably mounted by a bearing 406 to a stationary vertical upright 408 adapted to be coupled to a pressurized water supply line (not shown). The stationary vertical upright 408 carries a ring gear 410 meshing with a bevel gear 412 carried by the sprinkler head 404 and rotated by a gear transmission, as will be described more particularly below, for rotating the sprinkler head about the vertical axis 413 of the sprinkler.

Sprinkler head 404 is formed with a nozzle 414 disposed at an incline to the vertical axis 413 of the sprinkler, and through which the water inletted from the water supply line through stationary upright 408 exits in the form of a jet. The front end 416 of nozzle 414 is of conical shape and terminates in a throat 418 constituting the smallest diameter portion of the nozzle, and thereby determining the rate of discharge of the water through the nozzle.

A rod-shaped plunger 420 having a conical tip is disposed within nozzle 414 and is movable from an extended position wherein the conical tip projects forwardly through the nozzle throat 418, to a retracted position (shown in FIG. 1) at the opposite end of the conical portion 416 of the nozzle. It will thus be seen that when the plunger 420 is in the extended position, it effectively restricts the nozzle diameter; and when the plunger is in the retracted position, it effectively enlarges the nozzle diameter.

Sprinkler head 404 includes a drive, driven by the energy of the water in the pressurized-water supply line, for cyclically reciprocating plunger 420 to its extended and retracted positions, and thereby for cyclically restricting and enlarging the nozzle water-passage area. The foregoing drive includes an impeller 422 disposed with a housing 424 carried by the sprinkler head 404 and rotatably mounted thereon by a shaft 426. For rotating impeller 422, a tube 428 is connected between a port 430 in the sprinkler head 404, and another port 432 leading into the interior of impeller housing 424. Tube 428 thus conducts pressurized water from the sprinkler inlet into the interior of impeller housing 424 for driving the impeller 422. Housing 424 also carries a short-range nozzle 434 for conducting the water thereafter to the atmosphere.

Shaft 426 rotated by impeller 422 drives a pinion 438 which in turn drives a gear transmission 440 including a plurality of gears terminating in an end gear 442. The latter meshes with spur gear 412, which, as indicated earlier, meshes with stationary ring gear 410 to rotate the sprinkler head 404 about the sprinkler vertical axis 413.

The stationary ring gear 410 is formed at its upper end with a stationary cam member 470 having a cam surface 471 engageable with the end of plunger 420 so as to reciprocate the plunger during the rotation of the nozzle 414 according to the configuration of the cam surface. As shown in FIG. 1*a*, cam surface 471 is of square configuration including rounded corners. This cam surface is disposed at an acute angle (e.g., 30°) to the sprinkler vertical axis 413 and at a right angle to the plunger 420 longitudinal axis. Plunger 420 is urged against cam surface 471 by a spring 472 interposed between apertured plate 456 of the nozzle, and an annular ring 473 fixed to the plunger.

It will thus be seen that during each cycle of rotation of the sprinkler nozzle 414, plunger 420 will be reciprocated within the nozzle by cam surface 471 such that the water distribution pattern outputted by the nozzle will substantially conform to the configuration of the cam surface 471. Thus, the outer tip of the plunger 420 will be closest to the nozzle throat 418 when the inner end of the plunger 420 engages the exact center of each of the four sides of the cam surface 471, thereby reducing the output and range of the water jet, and will be farthest from the nozzle throat when the inner end of the plunger engages a corner joining the two adjacent sides of the cam surface 471, thereby increasing the output and the range of the sprinkler. Thus, the sprinkler will produce a square water-distribution pattern conforming to the square-shaped cam surface 471 of the cam member 470.

As shown in FIG. 1*b*, apertured plate 456 is actually constituted of a pair of rings 456*a*, 456*b*, secured concentrically by a plurality of ribs 456*c*. In order to prevent rotation of the plunger 420, the inner ring 456*b* constituting the aperture in wall 456, and the section 420*a* of the plunger passing through this aperture, are both of square shape. In addition, to facilitate adjusting the plunger, its outer end is preferably in the form of a separate section 420*b* threadedly received in section 420*a*, and its outer tip is formed with a slot 420*c* to facilitate threadingly adjusting the outer section by the use of a screwdriver.

The sprinkler illustrated in FIG. 1 operates as follows:

The main portion of the water inletted into the sprinkler housing 402 via its stationary upright 408 issues in the form of a jet through throat 418 of the main nozzle 414. However, a portion of the pressurized water passes through tube 428 to rotate impeller 422, and is outletted through the short-range nozzle 434.

Rotation of impeller 422 acts, via gear transmission 440 and spur gear 412 meshing with stationary ring gear 410, to rotate the sprinkler head 404 about the sprinkler axis 413. During this rotation of the sprinkler head, the inner end of its plunger 420 follows the configuration of cam surface 471 to displace or reciprocate the outer end of the plunger with respect to the nozzle throat 418, thereby causing the sprinkler to produce a water distribution pattern of substantially square shape in accordance with the square-shaped cam surface 471.

Figures 2, 2A:
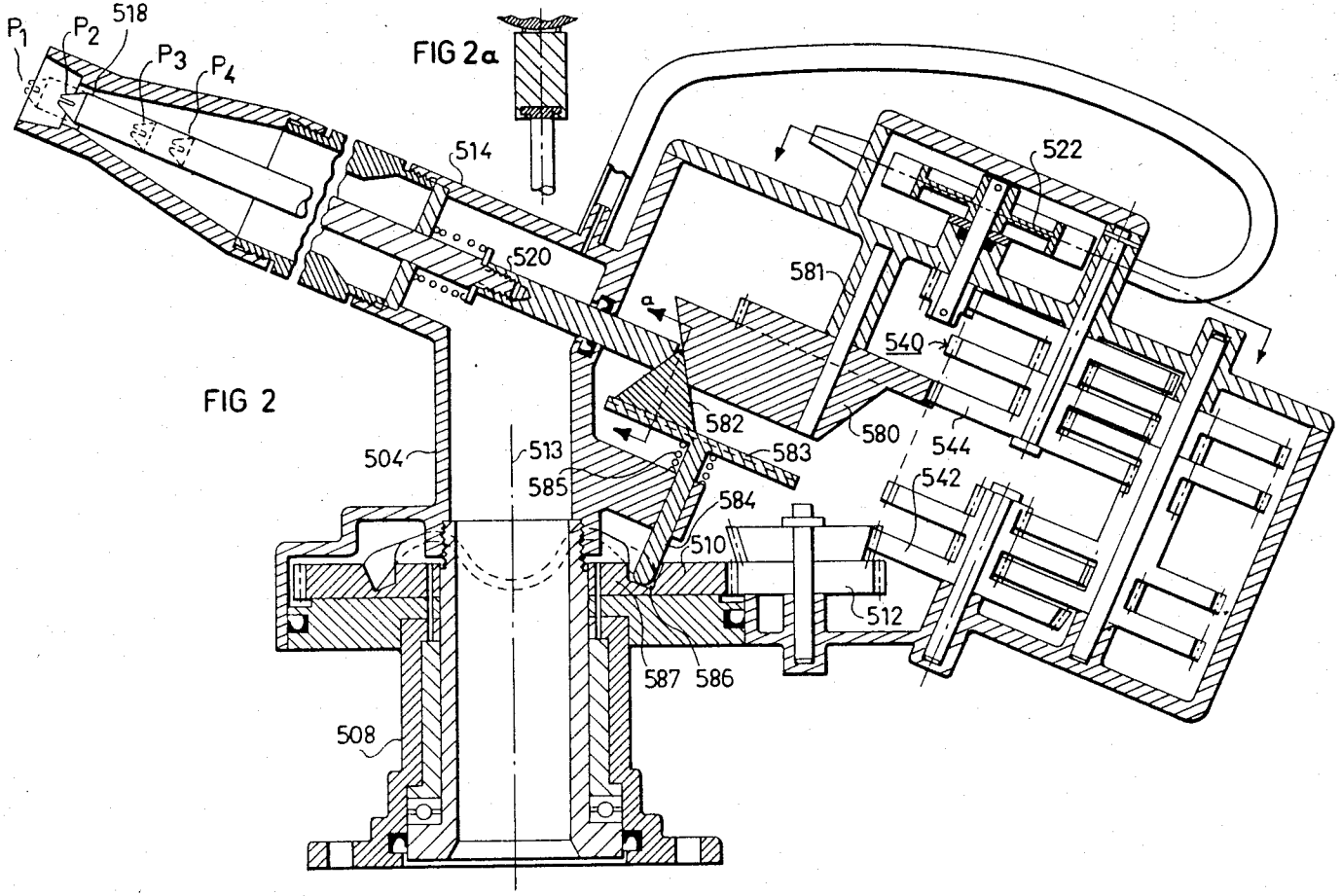
FIG. 2 is a longitudinal sectional view illustrating a second water sprinkler constructed in accordance with the invention of the present application, FIG. 2*a* being a sectional view along lines a—a of FIG. 2.

The embodiment of the invention illustrated in FIG. 2 is similar to that of FIG. 1, but includes a number of modifications as more particularly set forth below.

Thus, one modification in the FIG. 2 arrangement is that the impeller drive, designated 522 in FIG. 2, not only rotates the sprinkler head of 504 and its nozzle 514 about the sprinkler vertical axis 513, but also reciprocates the plunger 520 through many rapid cycles during each cycle of rotation of the sprinkler head. This is accomplished by the addition of an eccentric cam 580 rotatably mounted to a shaft 581 and coupled to gear 544 of the gear mechanism 540 driven by impeller 522, the outer face of the eccentric cam being effective to drive plunger 520.

Cam 580 does not drive plunger 520 directly, but rather through an interposer member 582 between the cam and the end of plunger 520. Interposer member 582 is of triangular configuration, and its base is slidably mounted on a carrier member 583 carried by a stem 584 passing through a bore in the sprinkler head 504. The opposite end of stem 584 is urged by a spring 585 to follow the cam-shaped surface 586 of a cam member 587 fixed to the stationary vertical upright 508 of the sprinkler.

It will thus be seen that as the sprinkler head 504 is rotated by spur gear 512 moving around stationary ring gear 510, in the manner described above with respect to the FIG. 1 embodiment, stem 584 follows cam surface 586, thereby moving the stem, and the triangular interposer 582, upwardly and downwardly with respect to the longitudinal axis of plunger 520, while the interposer 582 is permitted to slide on the carrier member 583 in the direction parallel to the plunger. The upward movement of interposer 582 displaces plunger 520 towards the nozzle throat 518, thereby decreasing the output and range of the sprinkler; whereas the downward movement of interposer 582 moves the plunger away from the nozzle throat 518, thereby increasing the range and output of the sprinkler.

The sprinkler illustrated in FIG. 2 operates as in FIG. 1, except that the provision of the eccentric cam 580 reciprocates the plunger 520, while the triangular interposer 582 displaced by the cam surface 586 during the rotation of the sprinkler, controls the displacement of the plunger in accordance with the shape of the cam surface 586. The arrangement is such that eccentric cam 580 reciprocates plunger 520 many times (e.g., at least 100 times) during each complete cycle of rotation of the sprinkler in order to increase the range and to decrease the output of the sprinkler in the same manner as described in the above-cited application, whereas interposer 582 is displaced according to the configuration of cam surface 586 to control the magnitude of the displacements of plunger 520 in order to produce a water distribution pattern around the sprinkler determined by the shape of cam surface 586 in the same manner as described above with respect to FIG. 1.

Figures 3, 3A:
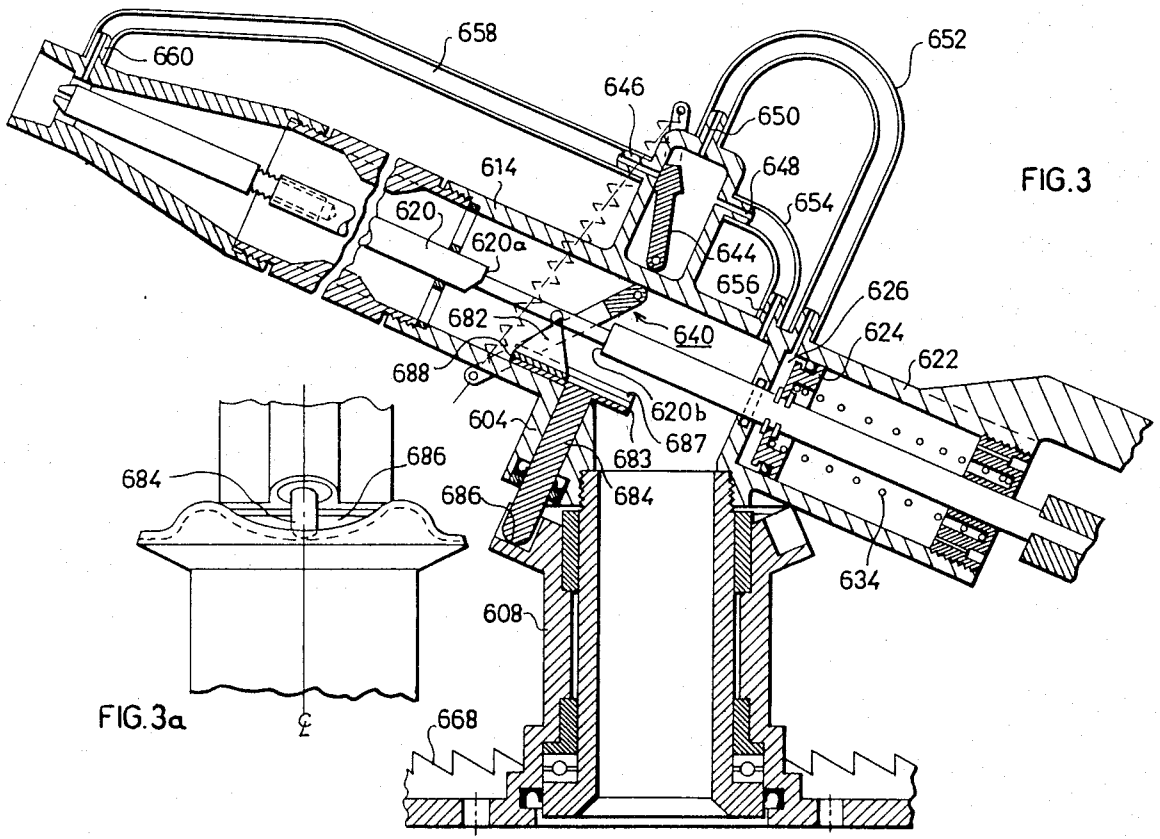
FIG. 3 is a longitudinal sectional view illustrating a third water sprinkler constructed in accordance with the invention, FIG. 3*a* illustrating a detail of the sprinkler of FIG. 3, and FIGS. 3*b* and 3*c* illustrating different positions of the sprinkler of FIG. 3.
Figures 4, 4A:
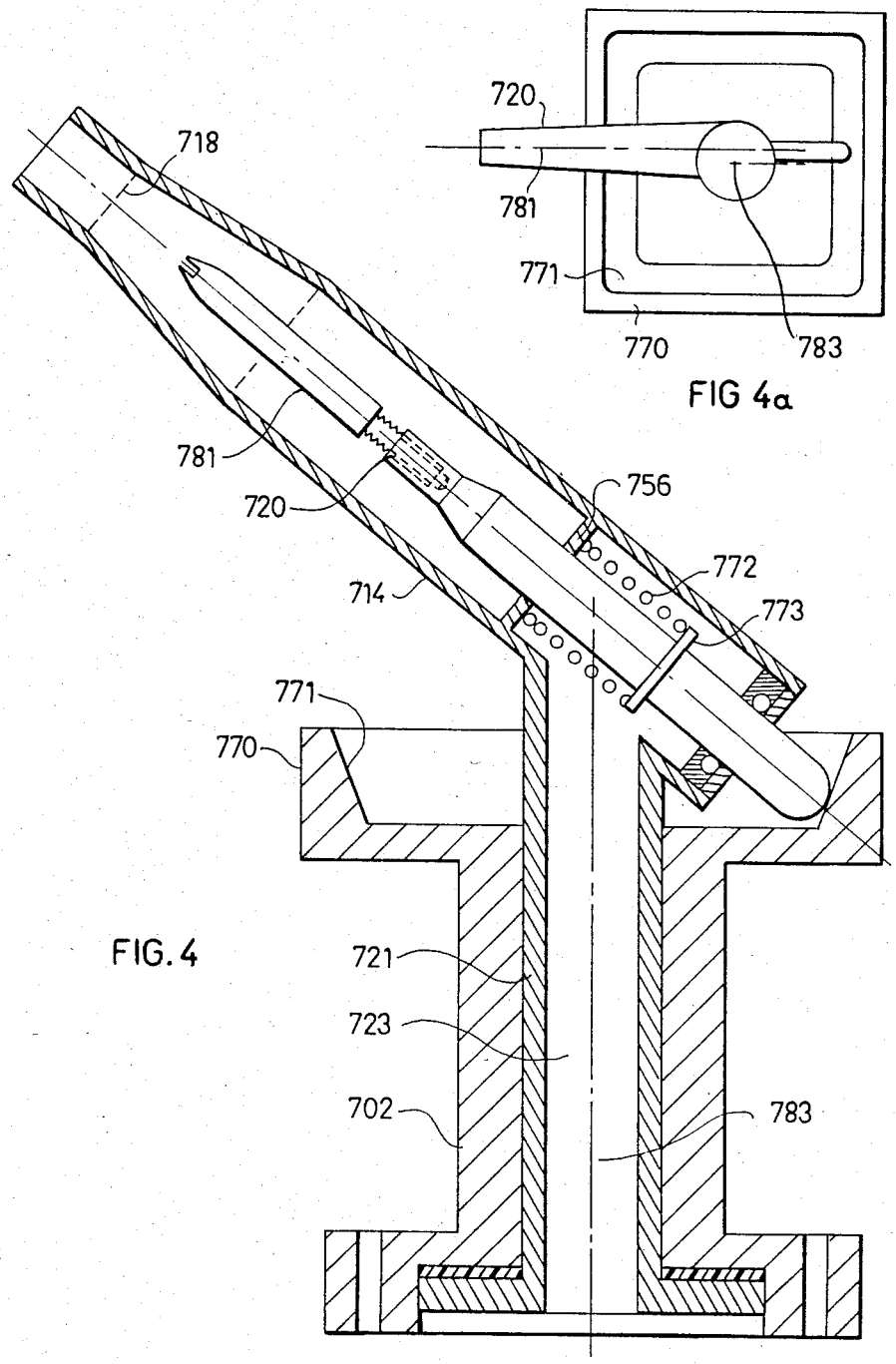
FIG. 4 is a longitudinal sectional view illustrating a still further embodiment of the invention, FIG. 4*a* being a top plan view of the sprinkler of FIG. 4.

The sprinkler illustrated in FIG. 3 is of the general type illustrated in FIG. 4 of the above-cited application but modified to include cam-controlled means similar to that of FIG. 2 for producing a specific water distribution pattern around the sprinkler.

Thus, the sprinkler illustrated in FIG. 3 includes a plunger 620 which is reciprocated within the nozzle 614 by piston 624 driven within cylinder 622 by pressurized water inletted into chamber 626, the return stroke being effected by return spring 634. A toggle assembly, generally designated 640, is actuated by shoulders 620*a* and 620*b* of the plunger 620, and includes a toggle member 644 adapted in one position of the toggle member to close a first port 646, and in the other position, to close a second port 648. A third port 650 is connected by tube 652 to chamber 626. Port 648 is connected by a further tube 654 to port 656 in the nozzle head 614 so as to receive pressurized water from the sprinkler inlet; and port 646 is connected by tube 658 to a further port 660 communicating with the nozzle throat 618 (or with any other low-pressure point in the nozzle).

It will thus be seen that in the FIG. 3 illustrated position of toggle member 644, communication is established from the sprinkler inlet to chamber 626 via ports 656, 648, and 650, and via tubes 654 and 652, such that the pressurized water expands chamber 626 and moves piston 624 rightwardly to drive plunger 620 through its retraction stroke. At the end of that stroke, shoulder 620*a* of the plunger actuates the toggle mechanism 640 to cause toggle member 644 to close port 648 and to establish communication between ports 650 and 646, whereupon chamber 626 is vented to the atmospher via tubes 652 and 658, and nozzle throat 618. Accordingly, return spring 634 is now able to drive piston 624 leftwardly, thereby driving plunger 620 through its extension stroke, which stroke is terminated by the engagement of shoulder 620*b* with the toggle mechanism 640.

During the reciprocation of plunger 620, the magnitude of its displacement is controlled by a triangular interposer member 682 movable up and down perpendicular to the axis of plunger 620, in a similar manner as in the FIG. 2 embodiment. Thus, the base of interposer 682 is slidably mounted, in the direction parallel to the plunger longitudinal axis, to a carrier member 683 fixed to the upper end of stem 684, which stem passes through a bore in the sprinkler head 604 and engages cam surface 686 formed annularly around the stationary sprinkler upright 608. In the arrangement of FIG. 3, however, eccentric cam (580 of FIG. 2) is not included, since the reciprocations are effected by the piston 624 movable within cylinder 622, and therefore the carrier member 683, slidably mounting the triangular interposer 682, includes a stop 687, 688 at both ends limiting the slidable displacement of the interposer. Also, the triangular interposer 682 is movable between the two shoulders 620*a*, 620*b* of the plunger 620 to control the magnitude of the displacements of the plunger as it is reciprocated by piston 624.

Figure 3B:
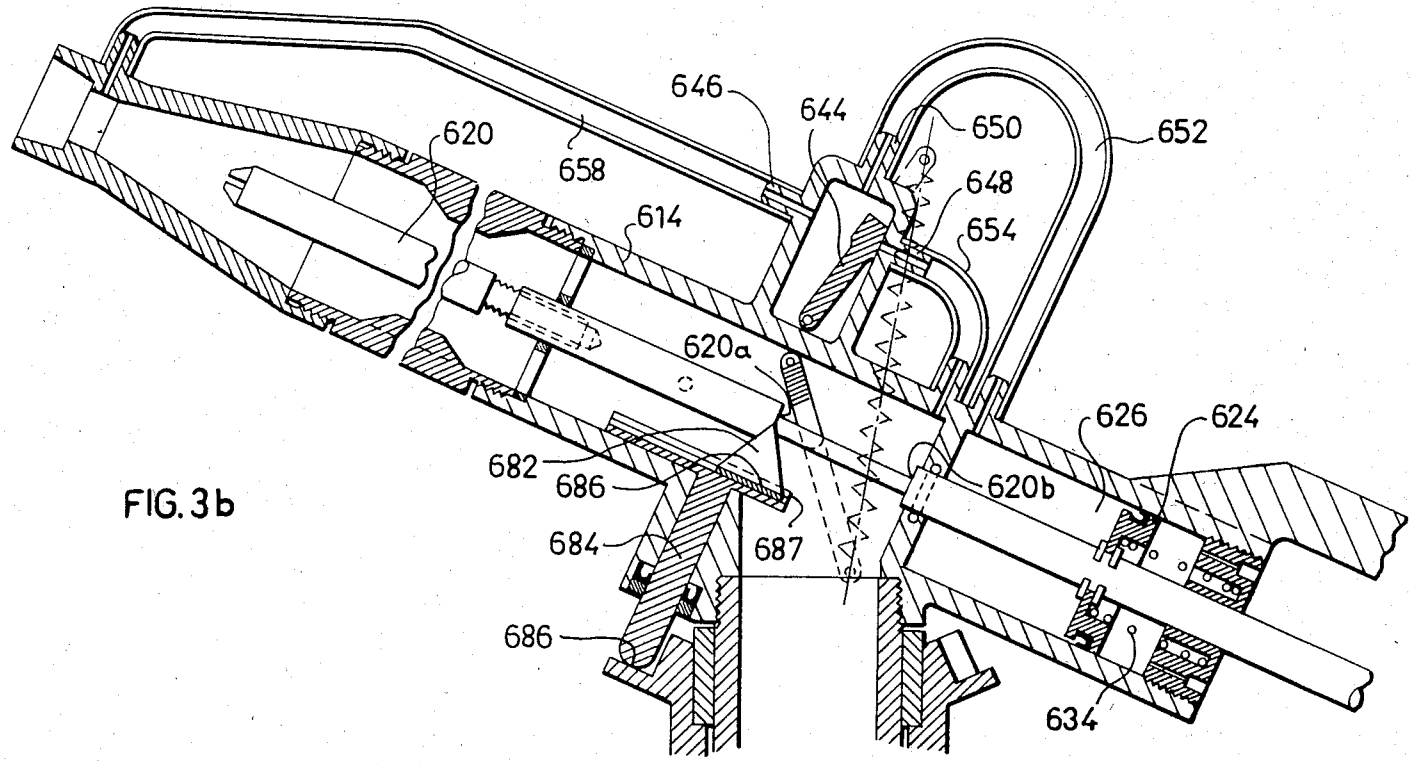

As described in patent application Ser. No. 594,727, during the operation of the sprinkler illustrated in FIG. 3, plunger 620 is reciprocated by piston 624 movable within cylinder 622, while the reciprocations of the plunger also cause the sprinkler head 604 to rotate, by a pawl (not shown) carried by the sprinkler head, movable into engagement and disengagement with the teeth of a circular ring 668 fixed to the stationary riser 608. As sprinkler head 604 rotates, stem 684 carried by it is displaced by cam surface 686 carried by the riser 608 to move the triangular interposer 682 upwardly and downwardly with respect to shoulders 620*a* and 620*b* of the plunger 620. During the rightward strokes of the plunger 620, its shoulder 620*a* engages triangular interposer 682 and slides it along its carrier plate 683 until limited by stop 687, thereby limiting the magnitude of the rightward reciprocations of the plunger, as shown in FIG. 3*b*. During the leftward reciprocations of the plunger, its shoulder 620*b* engages triangular interposer 682 and moves it in the opposite direction until limited by stop 688, thereby limiting the magnitude of the leftward reciprocations of the plunger.

Figures 3C, 5:
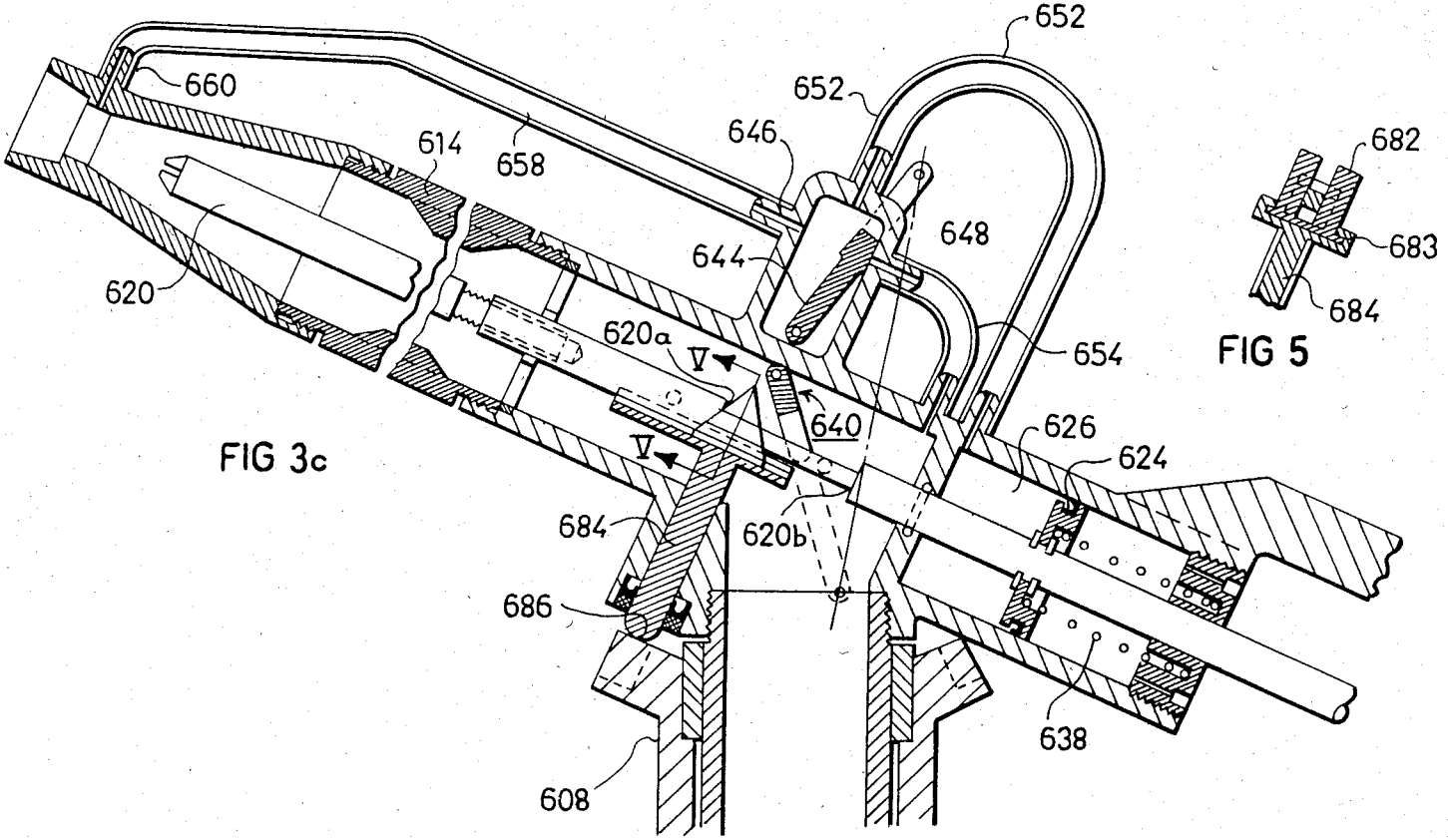
FIG. 5 is a view along line V—V of FIG. 3C.

It will be seen that triangular interposer 682 determines the magnitude of the reciprocations of the plunger in accordance with the shape of the cam surface 686; thus, low faces on the cam surface will lower the triangular interposer 682, thereby causing it to be engaged later in each reciprocatory stroke of the plunger, whereas high faces on the cam surface will raise the triangular interposer causing it to be engaged earlier in each reciprocatory cycle. When the triangular interposer 682 is in its lower position, as illustrated in FIGS. 3 and 3*b*, the magnitude of the plunger reciprocations will be larger, thereby increasing the range and output of the water sprinkler; whereas when the triangular interposer is in its higher position, as illustrated in FIG. 3*c*. the magnitude of the plunger reciprocations will be smaller thereby, reducing the range and the output of the sprinkler.

FIGS. 4 and 4*a* illustrate a still further embodiment of the invention, which embodiment also includes a housing 702 rotatably mounting a nozzle 714 having a rod-shaped plunger 720 movable towards and away from the nozzle throat 718. In this case, however, the nozzle includes a vertical stem 721 rotatably received within the housing 702 for rotatably mounting the nozzle. Stem 721 is formed with a passageway 723 for directing the water from the housing inlet to the nozzle 714.

A stationary cam member 720 is carried at the upper end of housing 702 and co-operates with the end of plunger 720 projecting through the rear end of the nozzle 714 during the rotation of the nozzle in order to control the plunger 720 so as to produce the desired water distribution pattern according to the configuration of the cam surface 771 of cam member 770. For purposes of example, cam surface 771 is of the same square configuration with rounded corners as illustrated in FIG. 1*a*. The rear end of plunger 720 is urged to engage cam surface 771 not only by the pressure of the water inletted into the nozzle, but also by a coil spring 772 interposed between an apertured wall 756 in the interior of nozzle 714, and a ring 773 carried by plunger 720.

As shown particularly in FIG. 4*a*, the longitudinal axis 781 of nozzle 714 is offset from the longitudinal axis 783 of stem 721, which latter axis 783 constitutes the axis of rotation of the nozzle. Accordingly, as the water exits from the nozzle, a reaction force is produced tending to rotate the nozzle about the vertical axis 783. It will be appreciated that during this rotation of the nozzle, the inner end of its plunger 720 follows the configuration of cam surface 771 so as to move the plunger towards and away from the nozzle throat 718, and thereby to produce a square water distribution pattern around the sprinkler.

While the invention has been described with respect to several preferred embodiments, it will be appreciated that many other variations, modifications, and applications of the invention may be made.

What is claimed is:

1. A water sprinkler comprising a housing having an inlet connectible to a pressurized water supply line; a nozzle carried by said housing and angularly displaceable about a vertical axis; a drive driven by the energy of the water in the pressurized water supply line for angularly displacing said nozzle about said vertical axis; a plunger movable to restrict and enlarge said nozzle; and a cam member effective during the angular displacement of the nozzle about said vertical axis, to control the displacement of said plunger so as to produce a water distribution pattern of predetermined configuration around the sprinkler.

2. The sprinkler according to claim 1, wherein said cam member is fixed with respect to the ground and includes a shaped cam surface engageable by a cam follower coupled to said plunger.

3. The sprinkler according to claim 2, wherein said cam follower is the end of said plunger.

4. The sprinkler according to claim 2, wherein said cam surface is concentric with the vertical axis of the sprinkler.

5. The sprinkler according to claim 4, wherein said cam surface is of polygonal configuration with rounded corners.

6. The sprinkler according to claim 4, wherein said cam surface is disposed at an acute angle to the sprinkler vertical axis and at a right angle to the plunger longitudinal axis.

7. The sprinkler according to claim 6, wherein said nozzle includes a vertical stem rotatably received in said housing for rotatably mounting the nozzle thereto, said stem being formed with a bore for directing the water therethrough to the nozzle.

8. The sprinkler according to claim 7 wherein the longitudinal axis of said nozzle is offset from its axis of rotation to the housing, such that the water exiting from said nozzle produces a reaction force rotating said nozzle with respect to said housing.

9. The sprinkler according to claim 1, wherein said drive includes rotary means for rotating said nozzle about said vertical axis, and reciprocating said nozzle about said vertical axis, and reciprocating means reciprocating said plunger within said nozzle.

10. The sprinkler according to claim 9, wherein said reciprocating means produces many reciprocations of said plunger for each displacement cycle of the nozzle, during which displacement cycle the magnitudes of the plunger reciprocations are controlled by said cam member to produce the water distribution pattern of predetermined configuration.

11. The sprinkler according to claim 10, wherein said cam member is engageable by a cam follower carrying an interposer member which is interposed between the reciprocating means and the plunger.

12. The sprinkler according to claim 11 wherein said interposer member is slidably mounted on a supporting member carried by said cam follower, said interposer member being slidable along an axis paralled to the longitudinal axis of the plunger.

13. The sprinkler according to claim 12, wherein said interposer member is of triangular shape and is slidably mounted at its base to the supporting member carried by said cam follower.

14. The sprinkler according to claim 13, wherein said cam follower includes a stem movable in a bore through an extension of said nozzle such that the lower end of said stem engages the cam surface of said cam member to cause said triangular interposer member to move with respect to said plunger and reciprocating means.

15. The sprinkler according to claim 9, wherein said reciprocating means comprises an eccentric cam rotated by said drive.

16. The sprinkler according to claim 9, wherein said reciprocating means comprises a piston driven within a cylinder by the energy of the water in the pressurized water supply line.

17. The sprinkler according to claim 9, wherein said reciprocating means produces at least 100 reciprocations of said plunger during each displacement cycle of the nozzle.

18. The sprinkler according to claim 1, wherein said plunger includes two parts adjustable with respect to each other to vary the length of said plunger with respect to said nozzle, and thereby to adjust the discharge rate from said nozzle.

* * * * *